US010651591B2

(12) United States Patent
Lerner et al.

(10) Patent No.: US 10,651,591 B2
(45) **Date of Patent: *May 12, 2020**

(54) SHOCK AND VIBRATION RESISTANT BULKHEAD CONNECTOR WITH PLIABLE CONTACTS

(71) Applicant: AOI (Advanced Oilfield Innovations, Inc.), Stafford, TX (US)

(72) Inventors: Daniel Maurice Lerner, Missouri City, TX (US); Andrew Lerner, Houston, TX (US); Andre Orban, Sugarland, TX (US)

(73) Assignee: AOI (Advanced Oilfield Innovations, Inc.), Stafford, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/458,183

(22) Filed: Mar. 14, 2017

(65) Prior Publication Data

US 2017/0187141 A1 Jun. 29, 2017

Related U.S. Application Data

(63) Continuation of application No. 14/562,164, filed on Dec. 5, 2014, now Pat. No. 9,634,427.
(Continued)

(51) Int. Cl.
*H01R 13/631* (2006.01)
*H01R 13/52* (2006.01)
(Continued)

(52) U.S. Cl.
CPC ..... *H01R 13/5202* (2013.01); *H01R 13/005* (2013.01); *H01R 13/521* (2013.01);
(Continued)

(58) Field of Classification Search
CPC ..... H01R 13/5202; H01R 15/5219; H01R 31/06; H01R 13/6315; H01R 23/02;
(Continued)

(56) References Cited

U.S. PATENT DOCUMENTS 2,743,592 A 5/1956 Nagy et al.
2,824,434 A 2/1958 Stern
(Continued)

*Primary Examiner* — Travis S Chambers
(74) *Attorney, Agent, or Firm* — ePatentManager.com; Guerry L. Grune

(57) ABSTRACT

A high pressure and temperature, hermetically sealed bulkhead connector with pin and socket contacts for use in logging tools is described. The bulkhead connector comprises (a) one or more contact(s) placed within one or more channels wherein the channels provide a clearance path between contact(s) and bulkhead body and travel at least a partial longitudinal distance between proximal and distal ends. The contact(s) reside in the channel(s) and include at least; an optional movement limiter section, one central elongated section, and one fixed section where the contact(s) is attached to the bulkhead body at the distal end. The body correctly positions respective ends of the contact so that the body secures contact(s) to be parallel to each other and the contact(s) have terminal ends for connection. This arrangement provides at least one pivotable, pliable, free floating contact extending away from the fixed distal end of the bulkhead body.

20 Claims, 5 Drawing Sheets

Related U.S. Application Data

(60) Provisional application No. 61/975,494, filed on Apr. 4, 2014.

(51) Int. Cl.

| | |
|---|---|
| ***H01R 13/00*** | (2006.01) |
| ***H01R 24/86*** | (2011.01) |
| ***H01R 13/533*** | (2006.01) |
| ***H01R 13/6581*** | (2011.01) |
| ***H01R 43/16*** | (2006.01) |
| ***H01R 31/06*** | (2006.01) |

(52) U.S. Cl.
CPC ..... *H01R 13/5205* (2013.01); *H01R 13/5219* (2013.01); *H01R 13/533* (2013.01); *H01R 13/6315* (2013.01); *H01R 13/6581* (2013.01); *H01R 24/86* (2013.01); *H01R 31/06* (2013.01); *H01R 43/16* (2013.01); *Y10T 29/4921* (2015.01); *Y10T 156/10* (2015.01)

(58) Field of Classification Search
CPC ..... H01R 13/5205; H01R 13/5219; H01R 24/86; H01R 13/005; H01R 43/16; H01R 13/6581; H01R 13/533; H01R 13/521; Y10T 29/4921; Y10T 156/10
USPC ..... 439/271, 246, 660
See application file for complete search history.

(56) References Cited

U.S. PATENT DOCUMENTS

| | | | | |
|---|---|---|---|---|
| 4,406,515 | A | 9/1983 | Roberts | |
| 4,420,210 | A | 12/1983 | Karol et al. | |
| 5,203,723 | A | 4/1993 | Ritter | |
| 5,588,086 | A * | 12/1996 | Fan | G02B 6/3816 174/11 R |
| 5,711,685 | A | 1/1998 | Wood | |
| 6,602,905 | B1 | 8/2003 | Gardiner et al. | |
| 7,249,971 | B2 * | 7/2007 | Burke | B29C 45/14639 439/589 |
| 7,364,451 | B2 | 4/2008 | Ring et al. | |
| 7,726,997 | B2 | 6/2010 | Kennedy et al. | |
| 8,267,707 | B2 * | 9/2012 | Rogers | H01R 13/52 439/271 |
| 8,992,243 | B2 * | 3/2015 | Cameron | H01R 13/5202 439/271 |
| 9,634,427 | B2 * | 4/2017 | Lerner | H01R 13/005 |
| 9,650,848 | B2 * | 5/2017 | Taylor | E21B 17/20 |
| 2007/0243762 | A1 | 10/2007 | Burke et al. | |
| 2012/0326431 | A1 | 12/2012 | Irwin et al. | |
| 2013/0065429 | A1 | 3/2013 | Spahi et al. | |
| 2015/0311639 | A1 * | 10/2015 | Neureiter | B60K 1/00 310/71 |

* cited by examiner

SHOCK AND VIBRATION RESISTANT BULKHEAD CONNECTOR WITH PLIABLE CONTACTS

PRIORITY

The present application is a continuation of and claims priority to U.S. patent application Ser. No. 14/562,164 filed Dec. 5, 2014, granted Apr. 25, 2017 as U.S. Pat. No. 9,634,427, which is a nonprovisional conversion of, and claims priority to, U.S. Provisional Application 61/975,494 filed Apr. 4, 2014, both entitled "Shock and Vibration Resistant Bulkhead Connector With Pliable Contacts". In addition, this application hereby expressly incorporates by reference, in its entirety, the same US applications provided above.

TECHNOLOGY

The present disclosure is directed to a bulkhead connector for use in oil and gas well logging, completion and drilling tools needed to optimize production. Bulkhead connectors are particularly useful in harsh high pressure and temperature environments where there is continuous shock and vibration. These connector types are normally hermetically sealed and required for making connections within down hole tools lowered in a well to depths where ambient temperatures often reach 500° F. and pressures often exceed 25,000 psi. The use of the term hermetic is meant to imply a seal that has the quality of being airtight and is impervious to air or gas.

BACKGROUND

Bulkhead connectors have been traditionally used for several decades primarily for subsurface, high temperature and pressure applications. These electrical connectors are provided to ensure connectivity with tools used in logging, completing, or during drilling of oil and gas wells. These tools consist of various electronic instruments contained within pressure housings which are maintained at atmospheric pressure. The electronics inside the pressure housing normally requires a hermetic type electrical connection that interconnects with electrical conductors (often in a wireline) to maintain communications with electronic instruments uphole normally at the surface. These hermetic connectors have contacts that can be either single-pin or multi-pin types depending upon the specific application. The connectors must also easily connect and disconnect and function as conduits for electrical conduction in extreme hostile liquid and gaseous environments that include exposure to brine, oil base drilling mud and fluids that may contain hydrogen sulfide, carbon dioxide, methane, and other corrosive elements as well as oil and gas at pressures often exceeding 25,000 psi and temperatures greater than 500° F.

These bulkhead connectors must also be constructed in such a way as to provide a hermetic seal capable of withstanding high differential pressures and temperatures in the presence of sudden or enduring shock and vibration, and maintain the ability to carry high voltages. Typically, when these specific connectors are exposed to borehole fluids, a rubber boot seal is used that fits over the male end of the connector contacts, thereby providing a moisture-free seal for the conductive contact(s) (or pins). Another possibility exists when these connectors are used inside the tools, in that the connectors could be used to seal against hydraulic oil used to hydrostatic pressure balance the mechanical section of the tools. In these cases, the bulkhead connector must also be capable of withstanding high differential pressure without a rubber boot seal. Similar issues exist regarding the need to protect the contacts from shock and vibration which occurs in the downhole environment.

A major source of electrical signal distortion or failure using these bulkhead connectors is associated with the original purpose of their design. Namely, the one or more contacts (pins) that protrude from the bulkhead surface (male portion) of the connector toward a receiving section of the connector (female portion or socket) are subject to extremely high shear forces during operation in harsh (shock and vibration) environments. This often leads to one or more of the electrical contacts being either severed or severely compromised, as the pins protruding from the bulkhead may be completely "cross-cut" or sheared. The contacts of the connector thereby no longer provide the required electrical connectivity for the device(s). Current bulkhead designs provide an absolute absence of the ability for flexure of the pin and socket arrangement(s). In fact, current designs are intended to be completely fixed and rigid so that there can be no movement either before or after the two ends of the connector are mated, helping to ensure the hermetic seal. These connectors can be hermaphroditic in that male pins can slide by one another, a pin and socket may exist on the same connector, or the connector may be a simple pin and socket arrangement.

In at least some instances, to avoid or at least diminish the possibility of absolute mechanical failure due to shear, the two bulkhead contact ends (pin and socket ends) are intentionally spaced apart by using a partial gap between the two outer portions of the bulkhead. Separation of this type, in some applications, leads to reduction of absolute shear failure incidents as the shear forces acting directly on the contact(s) is slightly reduced. One tradeoff in using this technique is that the bulkhead no longer provides the intended hermetic seal integrity for which it was originally designed. This can lead to premature contact failure due to the corrosive environments in which the connectors operate. Also, this technique results in a reduction and loss of contact area, leading to an increase in resistivity that is concurrent with a loss in power reduction and/or signal integrity.

A typical single pin type connector to which the invention pertains includes a conductive pin in the center covered by an insulating material which in turn is encased in a body. Single pin hermetic connectors made from polymers have been known to exist at least as early as since 1985. Halliburton Logging Services, Inc., Halliburton Co., made electrical connectors from Fiberite FM-4005F resin phenolic by both transfer mold and injection mold techniques. These connectors were limited to a maximum of 20,000 psi and are similar to the present invention including the fact that the pin can be threaded or press fit into the body. The body is usually formed from thermoplastics or thermoset polymers. This type construction is limited by the strength of the polymer bond (often epoxy) which results in deformation of the plastic body at high pressure and temperature. Furthermore, an interference fit of the pin in the body could damage the plastic body during assembly resulting in a high scrap rate which increases manufacturing costs.

Multi-pin connectors have also been manufactured using polymers since at least the early 1990's for existing high pressure and temperature applications in down hole applications. The multiple-pin plastic connectors have been designed to withstand pressure to 28,000 psi at 510° F. for numerous cycles. These designs provided an advantage in that plastic is not a rigid material. The plastic construction has forgiving characteristics that at high temperatures will relax and adjust to thermal expansion of primarily the bulkhead body without causing the multi-pin connector to fail due to harsh environments. Plastic single-pin connectors exhibit this same forgiving characteristic.

However, due to the enormous stresses generated due to shock and vibration, the need to distribute (primarily shearing) stresses acting on a single point is critical to avoid shearing of the contacts extending outwardly from the connector. Even though the stresses are generally more uniform for single contact (pin) connectors with respect to the geometric pin configuration, multiple pin connectors, which are more sensitive to temperature distribution anomalies and small manufacturing defects, should be also designed to survive the stresses described.

SUMMARY OF THE INVENTION

It is therefore one object of the present invention to overcome the shortcomings and disadvantages of currently available bulkhead (hermetically sealed) connectors and replace them with an alternative bulkhead connector still capable of withstanding the severe downhole conditions. The invention provides a device and method for transferring failure causing stresses on one or more contacts to that of a larger surface area using a pressure transfer guide plate. This transfer of forces allows primarily for transfer of the shear force away from a fixed end contact (pin) and associated pivot point and into the transfer plate. To further ensure shear force reduction, the contacts are also provided within a channel designed to allow free floating of the contacts. This further ensures that the contacts will endure these shear stresses without failing.

More specifically, the bulkhead connector comprises; a bulkhead body having a proximal end and a distal end, and an external sealing surface, with at least one channel that is positioned between the proximal and distal end along a central axial axis within the bulkhead body wherein;

(a) at least one conductive contact is placed within the channel and wherein the channel provides a clearance path between the contact and the bulkhead body that travels at least a partial longitudinal distance between the proximal end and the distal end; and (b) wherein the contact resides in the channel and the channel includes (1) an optional movement limiter section, (2) at least one central elongated section, and (3) at least one fixed section where the contact is attached to at least a portion of the bulkhead body at the distal end; and (c) wherein the body has openings therethrough to encircle and fit about and in a surrounding relationship to the contacts and the body has an external sealing surface therearound; and (d) wherein the body surrounds the limiter section, the central elongated section and the fixed section of the contact that correctly positions respective ends of the contact to be exposed for connection with a circuit, and wherein the body secures the contacts parallel to each other and wherein the contacts have terminal ends for connection (e) thereby providing, at least one pivotable, free floating contact wherein the contact extends in a direction away from the fixed distal end of the bulkhead body and toward the proximate end thereby reducing shear stress concentrations at the fixed distal end; and (f) wherein the body and the contacts are bonded at surfaces that prevent leakage along the contacts; and (g) at least a partially protruding member which contacts and is bonded with the external sealing surfaces of the body wherein the member is abutting the body and provides at least one aligned opening aligned in a section of the body so that each contact is able to extend through the member and through the opening in a position that provides at least one contact point on one side of the member and at least another contact point on an opposite side of the member such that connection with the member from either side is possible; and (h) an optional housing which contacts, surrounds, and bonds with the external sealing surface of the body wherein the housing is formed of a material composition that supports a wall transverse thereacross and is abutting the body, and the wall enables the body to be registered thereagainst and held in a sealing relationship and;

(i) the contacts provide individual electrically insulated connections through the hermetically sealed housing.

Further to above, the bulkhead connector includes, toward the distal end of the channels, a pressure transfer guide plate that transfers shear force away from the contact and into the transfer plate and also acts as a stop for bonding material from exiting the distal end.

The transfer plate is manufactured from at least one of the group consisting of; ceramics, ferritic ceramics, non-ferrite metals, electrically conductive compositions, magnetic compositions, and electromagnetic adsorbing metals, wherein an electromagnetic absorption capability assists with reducing signal distortion through the bulkhead connector. In addition, one or more sealing ring(s) can be placed in at least one groove that exists circumferentially along an external surface of the housing and wherein a bulkhead utilizing the bulkhead connector is cooperative with sealing ring(s) and permits hermetic sealing interconnection between the housing and the bulkhead.

The present invention can also be described as a bulkhead connector comprising: a bulkhead body having a proximal end and a distal end, and an external sealing surface, with at least one channel that is positioned between proximal and distal ends along a central axial axis within the bulkhead body wherein;

(a) at least one conductive contact is placed within the channel(s) and wherein the channel(s) provides a clearance path between the contact(s) and the bulkhead body that travels at least a partial longitudinal distance between the proximal end and the distal end; and (b) wherein the conductive contact(s) reside in the channel (s) and has two ends and a central elongate portion thereof which the central portion includes an irregular surface along a length of the contact(s);

(c) the bulkhead body surrounding the central elongate portion of the contact thereby leaving two ends of the contact exposed for connection in a circuit;

(d) the central elongate portion of the contact(s) residing in the channel(s) is designed to allow the contact(s) to float freely and wherein the contact(s) extend in a direction away from the fixed distal end of the bulkhead body and toward the proximate end which reduces shear stress concentrations at the fixed distal end;

(e) wherein the body is bonded together with the channels(s) that hold at least a portion of the irregular surface of the central elongate portion of the contact(s) thereby eliminating leakage into and along the channel(s);

(f) wherein the body tightly fits together and surrounds the channels and the contact(s) and includes an external sealing surface;

(g) an optional surrounding housing fixedly adhered about the body at the external sealing surface;

(h) a wall having a transverse face extending fully across the housing, the wall enabling the body to be registered and held in a sealing relationship within the housing and against the wall;

(i) wherein the body and the contact(s) are bonded at surfaces that prevent leakage along the contact(s);

(j) an aligned opening in the wall to align the channel(s) and the contact(s) and enable the contact(s) to extend through the wall;

(k) wherein the exposed ends of the contact(s) extend through the wall and are exposed on opposite sides of the walls.

As above, the bulkhead connector includes, toward the distal end of the channels, a pressure transfer guide plate that transfers shear force away from the contact and into the transfer plate and also acts as a stop for bonding material from exiting the distal end. The transfer plate is manufactured from at least one of the group consisting of; ceramics, ferritic ceramics, non-ferrite metals, electrically conductive compositions, magnetic compositions, and electromagnetic adsorbing metals, wherein an electromagnetic absorption capability assists with reducing signal distortion through the bulkhead connector. In addition, one or more sealing ring(s) can be placed in at least one groove that exists circumferentially along an external surface of the housing and wherein a bulkhead utilizing the bulkhead connector is cooperative with sealing ring(s) and permits hermetic sealing interconnection between the housing and the bulkhead.

Additional objects of the invention include embodiments that employ for example, an optional insulative sleeve having a length positioned around each of the contacts that enables the contacts to be electrically insulated from the wall to avoid electrical grounding thereto.

Also, an at least one sealing ring resides in at least one groove extending circumferentially along the housing to permit interconnection in a hermetical sealing fashion between the housing and a bulkhead which is provided depending on the method for assembling the connector.

In an additional embodiment, the connections with the contact(s) can be individually connected and are hermetically sealed within the housing. Further, the hermetic seal keeps the contacts operational at pressures exceeding 25,000 psi and temperatures exceeding 500° F.

In many embodiments of the present invention, the contacts are pins or sockets or a set of both and the contacts are fully connected when the pins and sockets are mated.

In another embodiment, the contact is one of two types of pins; wherein one type of pin has two extended pinned insertion ends (with an optional spring loaded clip) and another type of pin has a collar sleeved receiving end (with an optional spring loaded clip adjacent to the collar sleeved end) and a pinned end. Optionally, the central elongated section of both types of pins include a set of cylindrical disks acting as ribs attached to an outer surface of the elongated section providing additional surface area thereby improving adhesion and mechanical rigidity with the body of the bulkhead connector.

In certain embodiments, the body of the bulkhead connector is comprised of polymeric materials that are either thermoplastic or thermosetting.

In certain other embodiments, the body is comprised of ceramic materials that are either ferritic or non-ferritic.

The housing of the bulkhead connector can also be comprised of either a conductive or non-conductive as well as magnetic or non-magnetic metal or a ceramic or a high temperature and pressure resistant polymer.

A further embodiment includes the use of a bulkhead connector comprising; a bulkhead body having a proximal end and a distal end, and an external sealing surface, with at least one channel that is positioned between the proximal and distal end along a central axial axis within the bulkhead body wherein;

(a) at least one glass fiber interconnecting conduit is placed within the channel(s) and wherein the channel(s) provides a clearance path between the conduit(s) and the bulkhead body that travels at least a partial longitudinal distance between the proximal end and the distal end; and (b) wherein the conduit(s) reside in the channel and includes;

(1) an optional movement limiter section, (2) at least one central elongated section, and (3) at least one fixed section wherein the conduit(s) is attached to at least a portion of the bulkhead body at the distal end; and (c) wherein the body has openings therethrough to encircle and fit about and in a surrounding relationship to the conduits(s) and the body has an external sealing surface therearound; and (d) wherein the body surrounds the limiter section, the central elongated section and the fixed section of the conduit(s) that forces positioning respective ends of the conduit(s) to be exposed for connection with hydraulic fluid, and wherein the body secures one or more conduit(s) to be parallel to each other and wherein the conduit(s) have terminal ends for connection (e) thereby providing, at least one pivotable, free floating conduit wherein the conduit(s) extend in a direction away from the fixed distal end of the bulkhead body and toward the proximate end thereby reducing shear stress concentrations at the fixed distal end; and (f) wherein the body and the conduit(s) are bonded at surfaces that prevent leakage along the conduit(s); and (g) optionally an at least partially protruding member which is bonded with the external sealing surface of the body wherein the member is abutting the body and provides at least one aligned opening that is aligned in the member and into the body so that each of the conduit(s) is able to extend through the member and through the opening in a position that provides at least one conduit interconnection point on one side of the member and at least another conduit interconnection point on an opposite side of the member such that connection with the conduit(s) from either side is possible; and (h) an optional housing which surrounds and bonds with the external sealing surface of the body wherein the housing is formed from a material composition that supports a wall transverse thereacross and is abutting the body, and the wall enables the body to be registered thereagainst and held in a sealing relationship; and (i) the conduit(s) provide individual insulated optical connections through the hermetically sealed housing.

BRIEF DESCRIPTION

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may have other equally effective embodiments.

DETAILED DESCRIPTION

As described above, the elastic limit of a (normally metal) material composition is often exceeded downhole when, for example, a contact (pin) is inserted into a socket in a mated arrangement where the pin is confined throughout the bulkhead body. This limit is easily exceeded when there is no tolerance or gap between the pin and the surrounding bulkhead body and when the pin is fixed at a position (within the fixed distal end) of the bulkhead body.

One embodiment of the present invention introduces pliable contacts for at least the pin and/or the socket arrangement of the bulkhead connector. These pliable contacts substantially reduce, and often eliminate metal fatigue of the pin either in or separate from the socket in bulkhead connector configurations. Pliability of the contacts is required to be sufficient to ensure that the expected probability of shear failure (especially in harsh environments) is eliminated. In order to achieve pliability of the pin and socket contacts and thereby provide a flexible connection, it is necessary to provide a gap (which is functionalized as a channel) between the contact and the bulkhead body where the contact resides. In addition, this embodiment also includes a pressure transfer guide plate, so that the forces acting on the contact are transferred from a single pivot point to the guide plate. This ensures that the elastic limit of the material from which the pin is composed residing in the socket, is not exceeded.

It is also possible to provide hyperboloid contacts as provided by IEH Corporation of 1458$^{th}$ St., Brooklyn, N.Y., where the hyperboloid construction resides inside a collared sleeve of either the pin or a conducting socket. This design allows for continuous interference fit contact with the overall connection within the bulkhead body of the connector.

Providing the proper mated arrangement to allow for flexible (instead of rigid) contacts of the connector during cycling of pressures, temperatures, shock, and vibration, ensures that proper contact is maintained throughout the life of the connector. The method of constructing these pliable contacts must remain simple and cost efficient using current machine shop practices without introducing special techniques other than currently used for manufacture of these connectors.

Figure 1A:
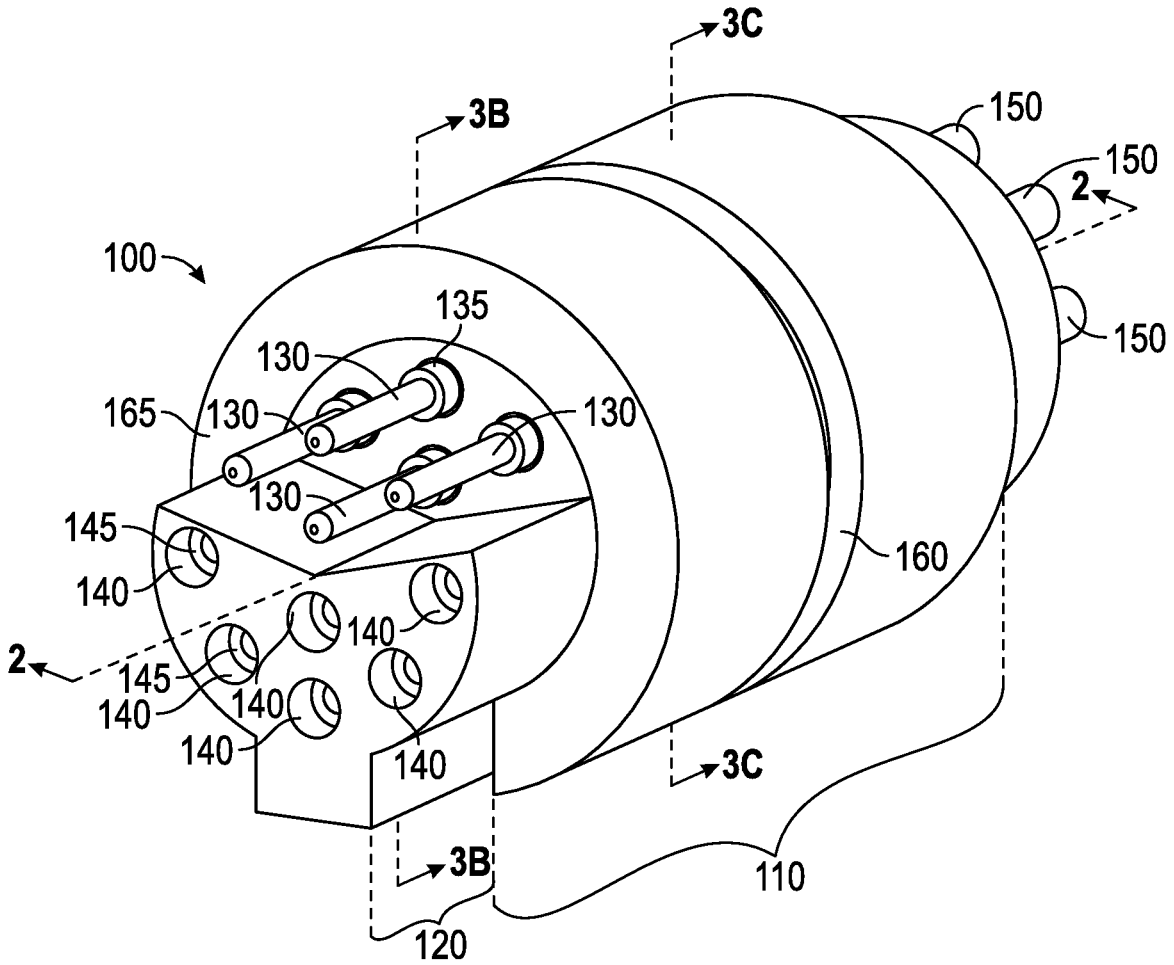
FIG. 1A is a perspective view of a multiple pin and socket bulkhead connector capable of hermetic sealing, wherein pins and sockets are surrounded in a body constructed so that reliable connectivity is accomplished in the presence of harsh temperature, pressure, shock and vibration environments.

Attention is first directed to FIG. 1A of the drawings where the numeral [100] identifies a multiple pinned embodiment of a pin and socket contact bulkhead connector. It will be described hereinafter as a bulkhead connector. As shown, the connector has a bulkhead body [110] with an outer housing [165]. Either molded or bonded to the bulkhead body [110] is a protruding member [120] which exhibits an external sealing surface of the body wherein the member [120] is abutting the body [110]. The member and body arrangement includes a shoulder with a relatively thin wall that is a proximate face of the body and circumferentially exists as an outer cylindrical portion between the bulkhead body [110] and the member [120]. In this case, provided, are six (6) aligned socket [140] openings and four (4) pins [130] that are aligned in the member [120] and extend into the body [110]. This allows each socket and pin contact to extend through the member [120]. The openings exist in a position that provides at least one contact point on one side of the member [120] and at least another contact point on an opposite side of the member [120]. Thus, a connection with the contact from either side of the body is possible. In this case, at the proximate end of the body of the bulkhead [110] are shown portions of the contacts, including the pins [130] and insulated sleeves [135] surrounding the pins [130]. The insulated sleeves [135] are located between a proximate section of the pins [130] and a point where the pins enter the bulkhead body [110]. Also shown are sockets [140], and recessed conductive sections of the sockets [145] that, like the pins [130] can extend in a protruding fashion at the distal end of the body [110] with terminal contact ends [150] exiting the bulkhead. These ends [150] may include solder cups for ensuring simple electrical connectivity with appropriate wiring.

Figure 1B:
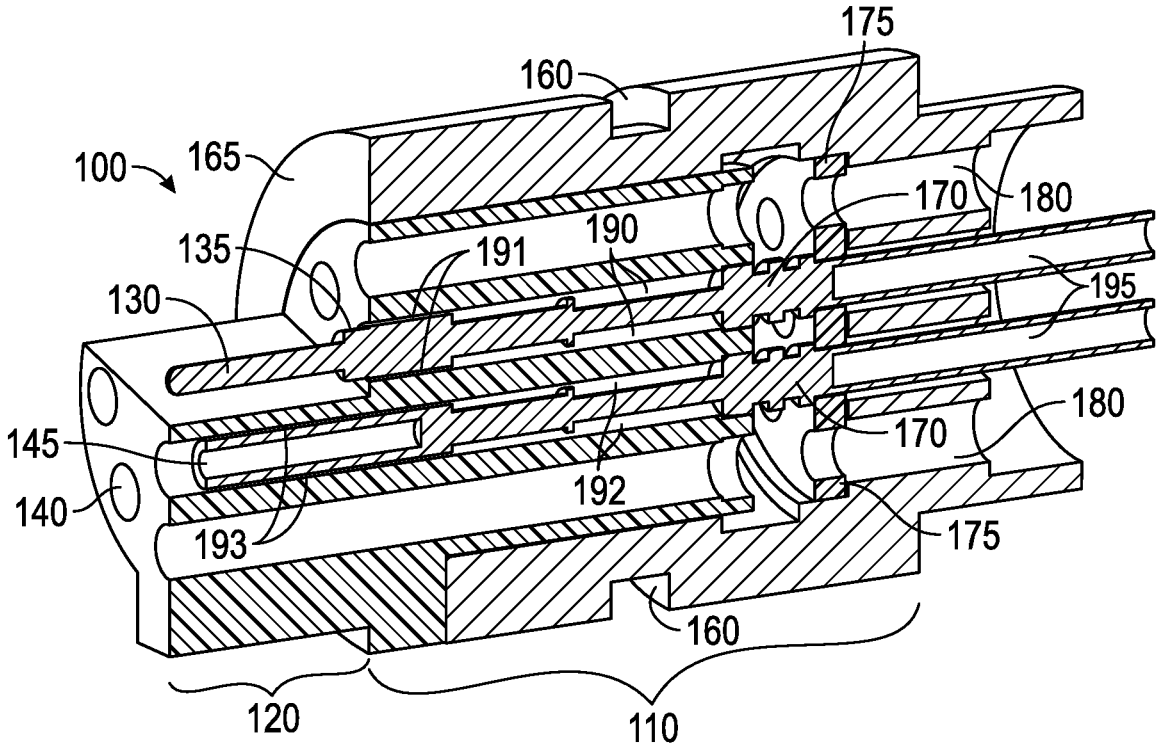
FIG. 1B is a cut away cross-sectional alternate view of FIG. 1A showing internal portions of a bulkhead body of the bulkhead connector that illustrates channels for the pins and sockets as well as a pressure transfer guide plate, and protruding contact sections for attaching with conductive wiring and still providing hermetic sealing.

The bulkhead body can include an outer housing [165] (in certain applications it is possible that an outer housing is not required) which is displayed here as having a depressed groove section [160] and also is represented in FIG. 1B as a grooved channel in the bulkhead body [110] (residing underneath the outer housing if there is one). In the depressed grooved channel [160] one or more sealing rings (which could be an "O" ring) can be used to ensure proper hermetic sealing between the underlying body [110] and the outer housing.

In some embodiments, multiple (two or more grooves) are typically provided and are incorporated to support seal rings (not shown). The diameter of the bulkhead body [110] of the connector is provided so that it plugs into a bulk head opening. The fittings necessary to anchor the device in a bulk head have been omitted for sake of clarity. By using suitable fittings, the connector is anchored at the bulk head by compressing the sealing rings to prevent leakage along the exterior. It is desirable that the pin be formed of conductive material. It can be an alloy or it can be a highly conductive material such as aluminum or copper and it can be plated or clad in an alloy to enhance connect-ability as well as wear. Moreover, the pin can be constructed with a number of threads and/or cylindrical rings along the length of the pin and/or conductive end of the socket and can extend the full length of the pins. In addition, shown are sliced-sections labeled as 3B and 3C which indicate the proper position for reference when viewing FIGS. 3A, 3B, and 3C.

FIG. 1B of the drawings shows the same embodiment as FIG. 1A, with emphasis on the internal elements of the bulkhead connector [100] which includes the bulkhead body [110] and the protruding member [120]. As the connector is viewed from the proximate end to the distal end, one of the many pins [130] is shown extending from the proximate end toward the distal end with a cross section of the insulated sleeve [135] prior to entering the bulkhead body [110]. The pin [130] extends into an initially narrow pin clearance channel [191] which expands into a wider pin clearance channel [190]. In this case, the pin [130] includes a set of cylindrical disks [170] acting as ribs attached to an outer surface of the elongated section providing additional surface area for better bonding with the body of the bulkhead [110]. The wider pin clearance channel [190] extends all the way to the set of cylindrical disks [170] which can be bonded (with epoxy or other suitable bonding materials) to the pressure transfer guide plate [175] that transfers shear force away from the pin [130] and into the transfer guide plate [175]. The transfer guide plate [175] also acts as a stop for bonding material agents from exiting the distal end. The plate [175] is manufactured from at least one of the group consisting of ceramics, ferritic ceramics, non-ferrite metals, electrically conductive, magnetic compositions, and electromagnetic adsorbing metals, wherein an electromagnetic absorption capability assists with reducing signal distortion. In a similar arrangement to the pin [130], the sockets [140] also extend toward the distal end and are shown extending into the member [120] and along the bulkhead body [110]. The sockets also are placed within initially narrow socket channels [193] that expand into the wider socket channels [192] and terminate identically to the pin [130]. More specifically, the wider socket channel [192] extends all the way to the set of cylindrical disks [170] which can be bonded (with epoxy or other suitable bonding materials) to the pressure transfer guide plate [175] that transfers shear force away from the sockets [140] and into the transfer guide plate [175]. Pin and socket channel sections [180] that began as channels at the proximate wall section of the bulkhead body [110], extend toward the distal end of the bulkhead body [110], past the transfer guide plate [175] as shown. Likewise, pin and socket channel sections [195] that began either in the member [120] or the body [110] of the bulkhead connector [100], extend toward and though the distal end of the bulkhead body [110], in this case, providing extensional ends of the channel sections [195] for coupling with electronic wiring. This may include the use of soldering cups, as needed.

FIG. 2 of the drawings is again the same embodiment, where the emphasis is placed on illustrating a completed cross-sectional diagram of the bulkhead connector [200] including the protruding member [120] and bonded (as one piece or in two or more pieces) with the bulkhead body [110]. The elements described are the same as FIGS. 1A and 1B above. Namely, proceeding from the proximate end toward the distal end of the connector [200], the pins [130] and sockets [140], extend through the protruding member [120] and into the bulkhead body [110]. The pin channels [190, 191] and socket channels [192,193] are as described above, and extend toward the proximate end of the bulkhead body [110]. These channels [190,191,192, and 193] can all extend past the bulkhead body [110] and eventually terminate as pin and socket channel sections [195].

Figure 3A:
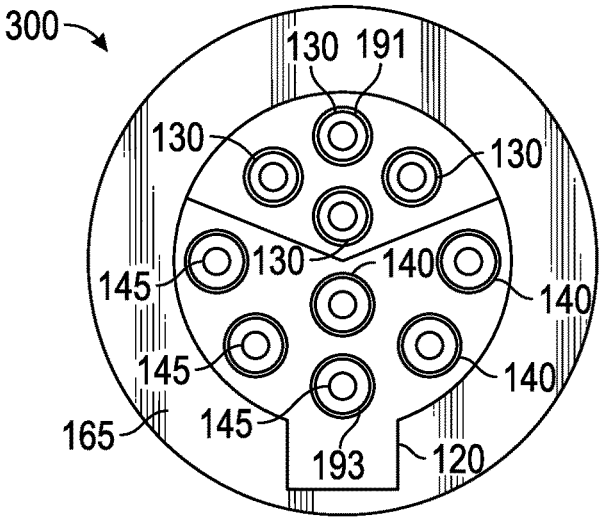
FIG. 3A is a top end view of the plug and socket arrangement as shown in FIG. 1A showing a multiplicity of pins, in this case, 4 pins and 6 sockets in number provide a multiconductor connection through the bulk head connector.
Figure 3B:
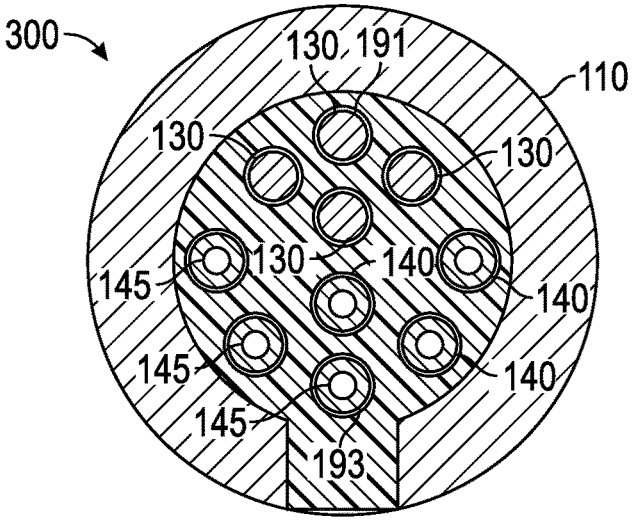
FIG. 3B is a cross-sectional view of a slice of the plug and socket arrangement located within a proximate first half portion of the outer housing as shown in FIG. 1A (see slice 3B as shown in FIG. 1A) showing a multiplicity of pins. As in the case above, 4 pins and 6 sockets in number provide this example of multi-conductor connections through the bulk head connector.
Figure 3C:
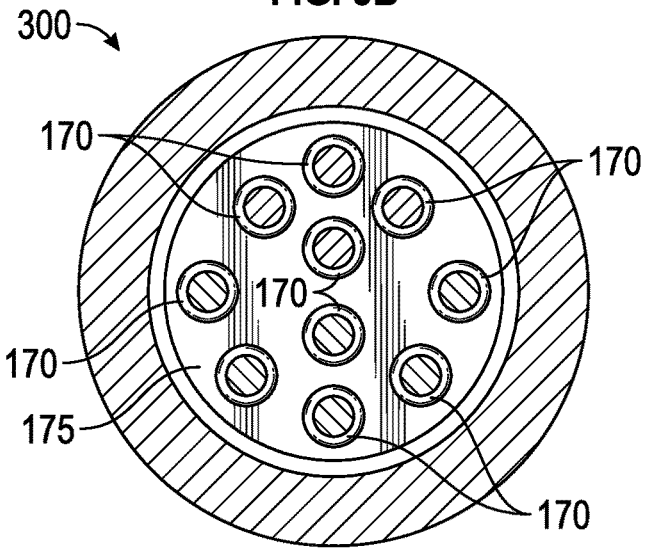
FIG. 3C is a cross-sectional view of a slice of the plug and socket arrangement located within a distal second half portion of the outer hosing as shown in FIG. 1A (see slice 3C as shown in FIG. 1A) showing a multiplicity of pins. As in the case above, 4 pins and 6 sockets in number provide this example of multi-conductor connections through the bulk head connector.

FIGS. 3A, 3B, and 3C of the drawings are also representative of different sections of the same embodiment of the present invention. FIG. 3A is a top end view of the bulkhead connector [300] looking at the proximate end [120] and illustrating all the features of the (in this case "10 pin") connector. The top set of pins [130] are shown with the accompanying narrow pin channels [191] providing the necessary clearance to ensure the pins are floating along their unfixed length. Likewise, sockets [140] are shown with and without recessed conductive sections of the sockets [145] and accompanying narrow socket channels [193] utilized for the same purpose. As shown and stated above, the outer cylindrical housing [165] has an external groove [160] which can receive a sealing ring.

Referring back to FIG. 1A, FIG. 3B is a sliced cross-sectional area of the bulkhead connector [300] corresponding with the section past the bulkhead member [120] shown in FIG. 3A and heading away from the proximate end toward the distal end of the bulkhead body (shown earlier as [110]). In this sliced section, the four pins [130] are residing in the wider pin channels [190] and the six sockets [140] with and with out the recessed conductive sections [145] are residing in the wider socket channels [192].

Again referring back to FIG. 1A, FIG. 3C is a sliced cross-sectional area of the bulkhead connector [300] corresponding with the section where the wider pin and socket channels [190, 193, shown earlier in FIG. 3B] terminate inside a more distal portion of the bulkhead body [110 shown earlier] at the pressure transfer guide plate [175] used to transfer shear force away from the pins [130] and sockets [140] (shown in FIG. 3A and FIG. 3B) and into the transfer guide plate [175] where a set of (normally solid) cylindrical disks [170] are attached to the distal ends of the pins and sockets for acting as ribs for better bonding with the bulkhead body [110].

Figure 4A:
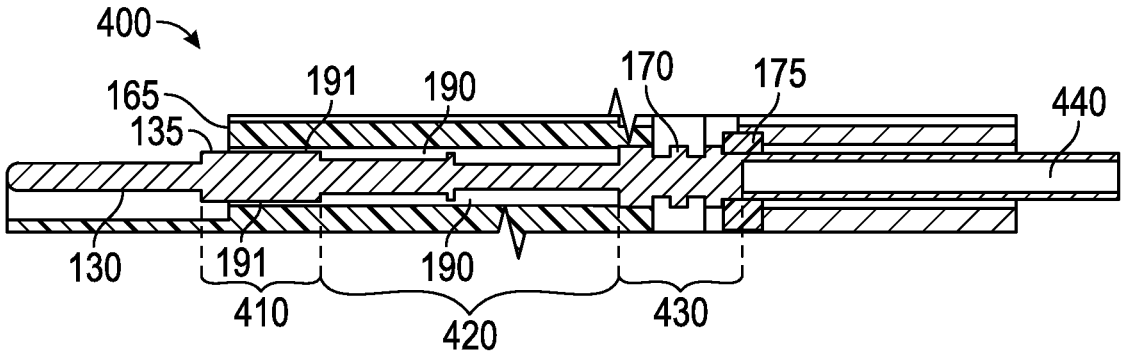
FIG. 4A shows a portion of the same cross-sectional arrangement as shown in FIG. 2, with the conventional pin and channel construction of the present invention.
Figure 4B:
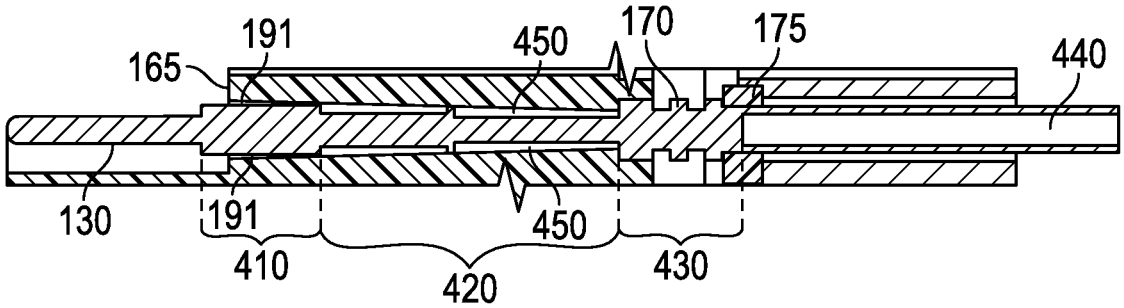
FIG. 4B shows a portion of the same cross-sectional arrangement as shown in FIG. 2 with the conventional pin but with a tapered channel construction within the body of the bulk head.
Figure 4C:
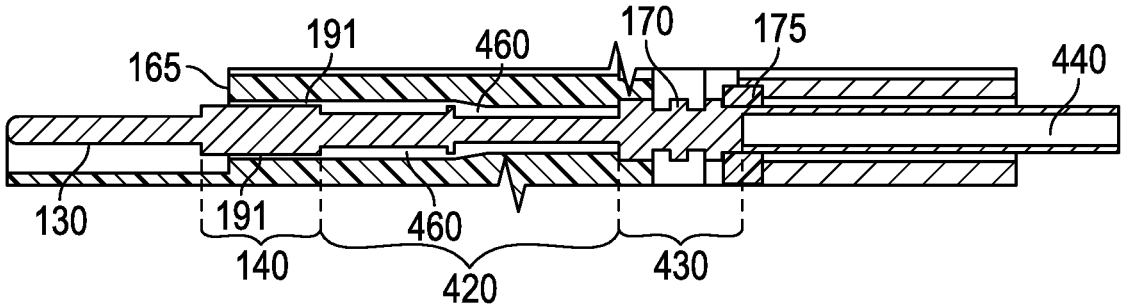
FIG. 4C shows a portion of the same cross-sectional arrangement as shown in FIG. 2 with the conventional pin but with a stepped channel construction within the body of the bulkhead.

FIGS. 4A, 4B, and 4C are specific to a cross section of one portion of the bulkhead connector [400] with an outer housing [165] that more clearly emphasizes three sections of a "conventional channel". In this case, "conventional channel" is meant to convey a narrow, wide (or both) channel (for pins or sockets or any contacts used) with constant width (circumference) dimensions along the length of the channel. From the leading proximate end of the cross section heading toward the distal end of the channel, the following elements are shown; an optional movement limiter section [410] corresponding to a narrow pin channel [191], at least one central elongated section [420], corresponding to where the wider pin channel begins [190], and at least one fixed section [430] corresponding to where the pin channels [190, 191]

end. At the fixed section [430] is where the pins and/or conductive portion of the sockets are attached to at least a portion of a set of cylindrical disks [170] acting as ribs attached to an outer surface of the elongated section exist. The wider pin channel [190] extends all the way to the set of cylindrical disks [170] which are bonded or otherwise sealed within the bulkhead body (using epoxy or other suitable bonding materials) to the pressure transfer guide plate [175]. The channel section marked [440] extends through the distal end of the bulkhead body (previously shown as [110]).

FIG. 4B is a schematic representation of the identical cross-section of the same embodiment with the exception that the wider pin channel is [190] is reduced in with using a tapered channel [450]. FIG. 4C is also an identical embodiment with the exception that the wider pin channel is reduced in width using either a gradual or sharp stepped [460] section, As mentioned, one or more clearance channels are formed in the bulkhead body and the pins and/or sockets can be threaded into the channels and held in place by an epoxy resin adhesive. Alternately, the pins and/or sockets can be positioned in the mold of an injection molding machine which casts the bulkhead body in place around the contacts. In both instances, this type construction is quite adequate to assure that no leakage occurs along the length of the contacts within the channels. Moreover, the method of joining or sealing of the bulkhead body to the contacts assures that no leakage occurs and that the two components which make up the construction hold together through numerous heating and cooling cycles. Holding a hermetic seal is in part dependent on the ability of the materials to yield without breaking its bond to the normally metal conducting contacts without accumulating excessive stress as a result of temperature differential in the expansion and contraction with heat cycling. An alternate approach is to thread the pins as mentioned above into holes in the bulkhead body with an epoxy resin adhesive placed in the holes. This permits curing of the epoxy resin to make a solid bond.

The bulk head body residing in the interior of the cylindrical housing is provided with suitable channels so that the contacts (pins) are able to extend through the channels. The contacts are electrically insulated by insulative material where the contacts extend through the bulk head body. This forms a resilient mounting mechanism which protects the individual contacts from shorting laterally with either the bulk head body or housing. More specifically, each of the contacts extends from the bulkhead body and does not contact metal but rather contacts the surrounding insulators positioned around the contacts. The (normally plastic) bulkhead body must be of sufficient strength to hold the pressure, maintain solid mounting, and to otherwise provide mechanical and structural integrity during thermal cycling as well as to ensure that the contacts will not fail due to excessive loads provided (normally) due to shock and vibration.

In general, the device of the present disclosure is able to handle excessive repetitive temperature and pressure cycling as well as repetitive shock and vibration (both). Furthermore, the hermetic connectors of the present invention should not exhibit any degradation of the insulation resistance after exposure to a number of heat and pressure cycles which will contribute to improvements in reliability and long life. Electrical resistance is due to at least two factors: (1) in the bulkhead body connector, the complete body is an insulator which makes the path from pin-to-ground a relatively long distance and (2) the pliability of the contacts influences the resistivity associated with the contacts (pins and/or sockets) especially if metal fatigue takes place. The present invention eliminates contact point bending as the cantilevered design allows for elasticity and flex, thereby eliminating metal fatigue of the fixed contacts within the bulkhead connector. Specifically, it is necessary that the contacts maintain a quality connection with the surrounding resilient material.

This is accomplished by casting in situ for bonding or attaching by an epoxy adhesive. In all instances, it is preferable that the contacts include threads (shown as cylindrical disks) so that they can be screwed into the bulkhead body. A snug, even tight fit with epoxy adhesive is necessary to assure that leakage under pressures at 28,000 psi does not occur along the respective contacts. This enables the appropriate hermetic seal to be accomplished so that the device can be cycled time and again during its use in well borehole applications where tools are lowered to great depths.

More specifically, there is a tradeoff between the elastic limit of the (normally) metal contacts vs. the clearance channels within the protruding member and bulkhead body, thus allowing for floating movement of the contacts. In at least one aspect of the invention, the ratio of the optional length of the movement limiter section [410] and the at least one central elongated section [420] length to at least one fixed section [430] vs. the elastic limit (yield stress) of the contact(s) is critical. This ratio, of the floating central elongated portion to the fixed end length versus the elastic limit changes is based on the required geometry of the bulkhead body. It is also possible to modify the width of the contacts (pins and or sockets or fibers in the case of glass fibers for fiber optics) by making the contacts narrower instead of the channels within which the contacts reside.

Heretofore, in earlier bulkhead connector designs, the movement limiter length and central elongated section length(s) have been fixed, with no clearance for floating and attached at one pivot portion at the fixed end. The configuration of the present invention overcomes the previous rigid bulkhead connector designs where exceeding the elastic limit very often occurs due to repeatedly bending or shearing of the contacts (pins). By allowing for movement of contact by using a movement limiter with clearance between the fixed portion of the bulkhead body and the contact, in whatever manner required, along with the use of the transfer guide plate to ensure load transfer, it is possible to keep the contacts below the elastic limit which normally is not possible due to irreversible stress of the contacts during normal operation.

Figure 2:
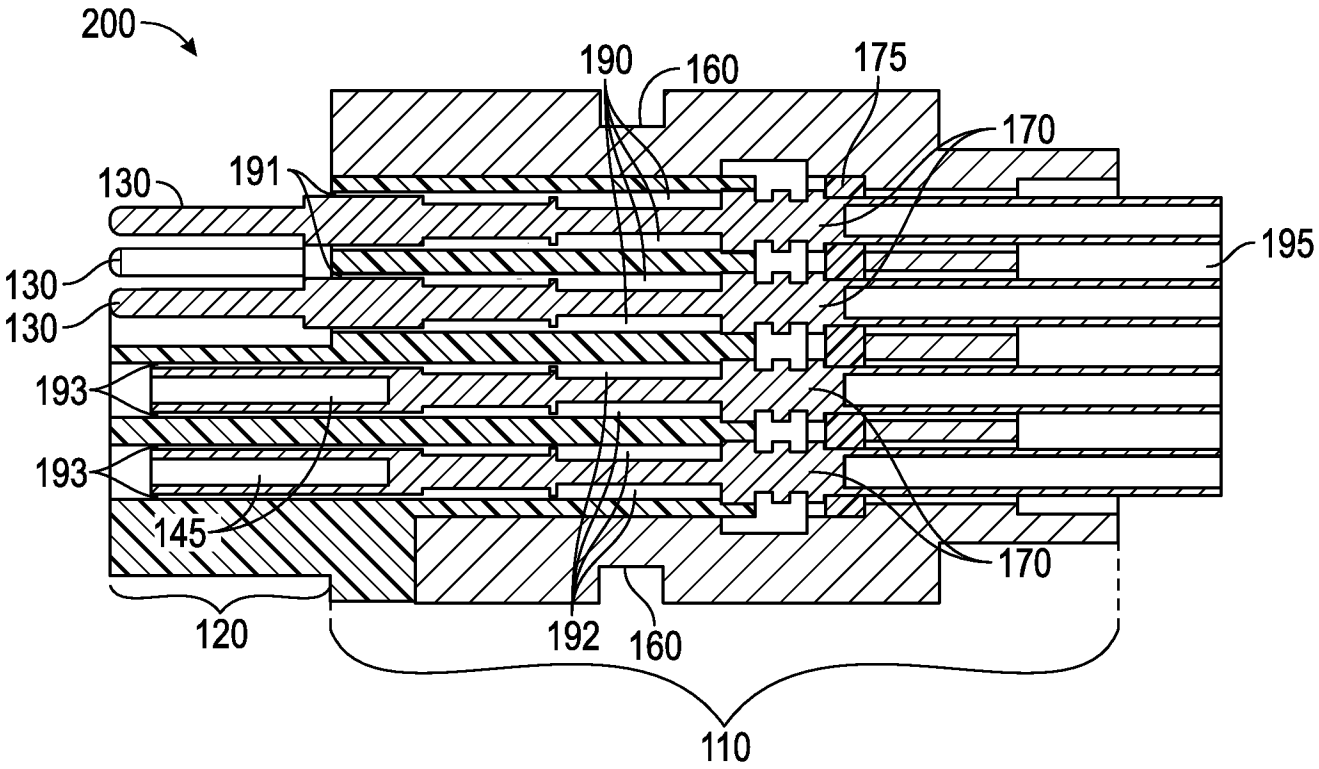
FIG. 2 is a lengthwise cross-sectional view of FIG. 1A (the axis if which is shown in FIG. 1A), illustrating the same internal portions of the bulkhead connector, but emphasizing specific features along the length of the channels, pins and sockets used to provide multiple connectors through the bulk head body of the connector.

In the installation of this connector, the embodiments of FIGS. 1-3 are normally inserted in a bulkhead opening with cooperative threaded fasteners such as lock washers and nuts. In the use of a single contacts (conductors) connection occurs at the ends of the pin to mechanically complete the circuit. The multiple pin connectors normally have cylindrical housings which are often constructed of steel or aluminum. The housing supports the bulkhead body residing within the housing; however, this can also be done by shaping the bulkhead opening in the same fashion. A sealing ring (such as an O-ring) and supportive shoulder can also form an acceptable seal.

Alternate polymers systems known to be acceptable for the bulkhead body and protruding member for this connector construction include but are not limited to: PEEK which is polyetheretherketone (glass filled may be preferred), Torlon® which is a polyamide-imide now sold by Solvay Polymers, Inc., PEK which is polyetherketone, also sold by Solvay Polymers, Inc. and Vespel®, which is a polyimide sold by E.I. DuPont DeNemours & Co., Inc. The body and non-metallic bulkhead connector assembly can comprise other polymeric materials that are thermosets or thermoplastics or a combination of both. The bulkhead connectors also can utilize ceramic materials that are ferritic, non-ferritic, or from the group consisting of a conductive, non-conductive, magnetic, and non-magnetic metals. In addition, the connectors can include materials from the group consisting of ceramic and high temperature/pressure resistant polymers. The transfer guide plates can be manufactured from at least one of the group consisting of ceramics, ferritic ceramics, non-ferrite metals, electrically conductive, magnetic compositions, and electromagnetic adsorbing metals, wherein an electromagnetic absorption capability assists with reducing signal distortion through the bulkhead connector.

While the foregoing is directed to the preferred embodiments, the scope of the present disclosure is set forth by the claims which follow.

We claim:

1. A bulkhead connector with one or more pins, sockets, or both pins and sockets comprising pliable contacts wherein metal fatigue of said pins either in or separate from said sockets in said bulkhead connector is eliminated;

and wherein a gap that is functionalized as a channel that exists between contact of said pins and a bulkhead body of said bulkhead connector where said pliable contacts reside and also includes a pressure transfer guide plate, so that forces acting on said pliable contacts are transferred from a single pivot point to said pressure transfer guide plate to ensure an elastic limit of material from which said pins are composed, with said pins residing in said sockets, is not exceeded.

2. The contacts of claim 1, wherein said contacts are hyperboloid contacts that allow for a continuous interference fit so that said contacts provide for an overall connection that connects said bulkhead body with said contacts of said bulkhead connector.

3. The bulkhead connector of claim 1, wherein a mated arrangement is proper and maintained that it allows for flexible contacts of said bulkhead connector, wherein flexibility endures during cycling of pressures, temperatures, shock, and vibration, to ensure that proper contact is maintained throughout bulkhead connector life which can be simulated during vibration, shock, and thermal cycling.

4. The bulkhead connector of claim 1, wherein said bulkhead connector allows each socket and pin contact to extend through a body of said bulkhead connector and wherein openings exist in a position that provides at least one contact point on one side of a bulkhead body of said bulkhead connector and at least another contact point on an opposite side of said bulkhead body of said bulkhead connector that provides for a connection with said pliable contacts from either side of said bulkhead body of said bulkhead connector.

5. The bulkhead connector of claim 1, wherein two or more grooves are provided and are incorporated to support sealing rings.

6. The bulkhead connector of claim 1, wherein said bulkhead body of said bulkhead connector does not include an outer housing and has a depressed groove section represented as a depressed grooved channel.

7. The bulkhead connector of claim 1, wherein a depressed grooved channel includes one or more sealing rings that ensure complete hermetic sealing between an underlying body portion of said bulkhead body of said bulkhead connector and an outer housing of said connector.

8. The bulkhead connector of claim 1, wherein sealing rings are "O" rings.

9. The bulkhead connector of claim 1, wherein at a proximate end of said bulkhead body of said bulkhead connector are portions of said contacts including said pins with insulated sleeves surrounding said pins.

10. The bulkhead connector of claim 9, wherein said insulated sleeves are located between a proximate section of said pins and a point where said pins enter said body of said connector.

11. The bulkhead connector of claim 10, wherein sockets and recessed conductive sections of said sockets exist and so that said pins extend in a protruding direction at a distal end of said bulkhead body of said bulkhead connector with terminal contact ends exiting said body of said connector.

12. The bulkhead connector of claim 11, wherein said terminal contact ends include solder cups for ensuring simple electrical connectivity with appropriate wiring.

13. The bulkhead connector of claim 1, wherein said bulkhead body of said bulkhead connector as viewed from a proximate end to a distal end has one of many pins extending from said proximate end toward said distal end with one or more insulated sleeves that exist prior to entering said bulkhead body of said bulkhead connector.

14. The bulkhead connector of claim 13, wherein said pins extend into an initially narrow pin clearance channel that expands into a wider pin clearance channel.

15. The bulkhead connector of claim 14, wherein said pins include a set of cylindrical disks acting as ribs attached to an outer surface of an elongated section of said bulkhead body of said bulkhead connector and provides additional surface area that allows for improved bonding with said bulkhead body of said bulkhead connector.

16. The bulkhead connector of claim 15, wherein said wider pin clearance channel extends all the way to said set of cylindrical disks which are bonded to said pressure transfer guide plate that transfers shear force away from said pins and into said pressure transfer guide plate.

17. The bulkhead connector of claim 16, wherein said pressure transfer guide plate also acts as a stop for bonding material agents from exiting said distal end of said bulkhead connector.

18. The bulkhead connector of claim 17, wherein said pressure transfer guide plate is manufactured from at least one of any of a group consisting of ceramics, ferritic ceramics, non-ferrite metals, electrically conductive, magnetic compositions, and electromagnetic adsorbing metals.

19. The bulkhead connector of claim 18, wherein an electromagnetic absorption capability exists and assists with reducing signal distortion for signals that exit, enter or enter and exit said bulkhead connector.

20. The bulkhead connector of claim 18, wherein said sockets also extend toward a distal end of said bulkhead connector and extend into said bulkhead body of said bulkhead connector wherein said sockets also have initial placement within narrow socket channels that expand into wider socket channels and terminate in an identical manner as said pins such that said wider socket channels extend all the way to said set of cylindrical disks that are bonded to said pressure transfer guide plate that transfers shear force away from said sockets and into said pressure transfer guide plate.

* * * * *